US007575391B2

(12) United States Patent
Tarazona de La Asunción

(10) Patent No.: US 7,575,391 B2
(45) Date of Patent: Aug. 18, 2009

(54) SYSTEM FOR PROTECTING INDIVIDUALS FROM IMPACTS AGAINST ROAD GUARD RAILS

(75) Inventor: Ramiro Tarazona de La Asunción, Tarazona (ES)

(73) Assignee: Taexpa, S.L., Tarazona (ES)

( * ) Notice: Subject to any disclaimer, the term of this patent is extended or adjusted under 35 U.S.C. 154(b) by 327 days.

(21) Appl. No.: 11/571,668

(22) PCT Filed: Jul. 6, 2005

(86) PCT No.: PCT/ES2005/000385

§ 371 (c)(1),
(2), (4) Date: Jan. 5, 2007

(87) PCT Pub. No.: WO2006/018458

PCT Pub. Date: Feb. 23, 2006

(65) Prior Publication Data

US 2008/0240853 A1 Oct. 2, 2008

(30) Foreign Application Priority Data

Jul. 15, 2004 (ES) ..... 200401739
Feb. 24, 2005 (ES) ..... 200500422

(51) Int. Cl.
*E01F 15/00* (2006.01)

(52) U.S. Cl. ..... 404/6; 404/10; 256/13.1; 188/371

(58) Field of Classification Search ..... 404/6, 404/10; 256/13.1; 188/371
See application file for complete search history.

(56) References Cited

U.S. PATENT DOCUMENTS

| | | | | |
|---|---|---|---|---|
| 4,244,156 | A | 1/1981 | Watts, Jr. | |
| 5,123,773 | A | 6/1992 | Yodock | |
| 5,192,157 | A * | 3/1993 | Laturner | 404/6 |
| 5,869,159 | A * | 2/1999 | Padilla | 428/40.1 |
| 6,010,275 | A * | 1/2000 | Fitch | 404/6 |
| 6,082,926 | A * | 7/2000 | Zimmer | 404/6 |
| 6,276,667 | B1 * | 8/2001 | Arthur | 256/13.1 |
| 6,290,427 | B1 | 9/2001 | Ochoa | |
| 6,494,640 | B2 * | 12/2002 | Roller | 404/6 |
| 6,533,250 | B2 * | 3/2003 | Arthur | 256/13.1 |
| 6,622,451 | B1 * | 9/2003 | Ellis | 52/835 |
| 7,090,428 | B2 * | 8/2006 | Hinojosa | 404/6 |
| 7,287,930 | B2 * | 10/2007 | Yamasaki et al. | 404/10 |
| 7,507,050 | B2 * | 3/2009 | McCue et al. | 404/6 |
| 7,510,346 | B2 * | 3/2009 | Riker | 404/9 |

(Continued)

FOREIGN PATENT DOCUMENTS

AU 2187600 9/2000

(Continued)

*Primary Examiner*—Gary S Hartmann
(74) *Attorney, Agent, or Firm*—Gifford, Krass, Sprinkle, Anderson & Citkowski, P.C.

(57) ABSTRACT

A system for protecting persons from impacts against road crash barriers in which the barrier rail has a curved upper part and has protuberances to absorb and decelerate the velocity of the vehicle or accident victim, and the posts supporting the barrier rail are provided with cladding formed of a number of concentric rings of variable thickness and made of material which deforms flexibly and recovers immediately which incorporates a housing designed to fit the post through pressure and a clamping effect in addition to any bar system.

7 Claims, 4 Drawing Sheets

U.S. PATENT DOCUMENTS

| | | | | |
|---|---|---|---|---|
| 7,513,710 | B2 * | 4/2009 | Demozzi et al. | 404/6 |
| 2003/0175477 | A1 | 9/2003 | Ellis | |
| 2004/0114996 | A1 * | 6/2004 | Cicinnati | 404/6 |
| 2004/0234333 | A1 | 11/2004 | Hinojosa | |

FOREIGN PATENT DOCUMENTS

| | | |
|---|---|---|
| CA | 1287730 | 8/1991 |
| CA | 2363093 | 8/2000 |
| DE | 8431736 | 1/1985 |
| EP | 1367008 | 12/2003 |
| EP | 1382747 | 1/2004 |
| ES | 1035536 | 1/1997 |
| ES | 1056863 | 5/2004 |
| ES | 2208119 | 6/2004 |
| FR | 2788796 | 7/2000 |

* cited by examiner

SYSTEM FOR PROTECTING INDIVIDUALS FROM IMPACTS AGAINST ROAD GUARD RAILS

FIELD OF THE INVENTION

This invention relates to a system for protecting persons, specifically motorists and cyclists, from impacts with road crash barriers as a result of an accident or a fall, or for any other reason. For this purpose the invention modifies the shape of the corrugated barrier rails and provides an impact-absorbing cladding around the posts supporting the said barrier rails.

As is known, the design of existing crash barriers has sharp edges on the barrier rails and on the posts which in the event of an impact act like guillotines, causing severe harm and also mutilating accident victims when they impact against them.

The protection system according to the invention offers the special feature that it can absorb impacts from all directions (270°) and can also break down the impact into three or more stages (with progressively lesser to greater resistance), at the same time diverting the accident victim's body from its trajectory towards the post of a crash barrier as a result of an "eccentric rotation" of the material comprising the said protection system as a result of which oscillation or back and forth movement of the "swing" type is created.

PRIOR ART

Systems for protecting the posts of crash barriers which are merely restricted to wrapping those posts with an impact-absorbing material, which do not provide for the possibility of diverting the impact away from the post, as a result of which the effectiveness of the alleged protection is greatly reduced, are known in the state of the art. As an example of the prior art mention may be made of the document ES-A-2 191 517.

SUMMARY OF THE INVENTION

There is therefore a need for a system for the protection of road crash barriers which overcomes the disadvantages of the prior art and which is cheap to manufacture and easy to install at the same time. This is achieved according to the invention through a system for protecting persons against impact with road crash barriers which comprise barrier rails in the form of corrugated barrier rails fixed to vertical supporting posts anchored in the ground, in which the corrugated barrier rail is curved at the top to avoid cuts if someone should fall upon it and has a number of protuberances in the longitudinal direction designed to absorb and decelerate the speed of the vehicle or person impacting against it and also to reduce the shock effect, each supporting post for the barrier rail being provided with a complex cladding comprising a succession of surfaces, preferably three, arranged in the form of concentric cylindrical rings emerging from a central core, designed for attachment of the cladding to the post, the core of which cladding is open longitudinally and accommodates the profile of the same in shape and size, it being provided that the said cylindrical surfaces offer the special feature that their thickness decreases progressively from the central core from which they emerge to reach a minimum thickness precisely in their central frontal and outer part. All the cladding on the posts is constructed of deformable flexible material which has the capability of recovering immediately, and the central core contains a housing which is designed to fit the post through pressure, and a clamping effect, the inner surface of the said housing bearing teeth in order to obtain a better grip on the said post.

According to the invention it is preferred that the number of the said concentric rings should be three.

Likewise, according to the invention, it is preferred that the deformable flexible material in those rings be preferably selected from the group of those in the nature of plastics. Protective cladding 5 according to the invention may be manufactured by any normal processes, but use of the extrusion process is nevertheless preferred.

In a second embodiment this invention also provides that the concentric rings extending from the posterior half of the core have a slightly oval configuration and are attached to each other by means of a plurality of radial reinforcing walls whose imaginary extensions converge at the centre of the core, in this case the external ring also being slightly thicker than the other inner rings. Because the rings surround the posterior half of the protective cladding according to the invention and these rings are joined together by means of radial walls, the impact resistance of the said cladding is increased and at the same time the required characteristics for absorbing such impacts are preserved. Furthermore, this protective cladding will fully recover its original configuration after it has been deformed as a result of an impact received. Likewise the use of radial reinforcing walls makes it possible to reduce the thickness of the said rings, with a consequent saving in material.

Also, according to the invention, it is preferred that for a more secure attachment the opening housing the cladding on the supporting post is enclosed with steel supporting clamps which enclose the said cladding in clips provided for the purpose.

As an alternative, according to the invention, the desired greater security of attachment for the cladding can also be achieved by means of appropriate adhesive bonding.

According to the invention, the cladding of the protection system may also adopt any desired shape, for example a cylindrical or prismatic shape with a square, triangular, diamond, etc., transverse cross-section.

According to the invention the core of the protective cladding has been designed with a transverse cross-section which is suitable for attachment for posts of channel or I cross-section, or any other configuration.

Likewise, if the transverse cross-section of the post is different from a channel or I configuration, it is provided that the core of the protective cladding of the invention is mounted therein through an intermediate coupling module which fits it.

BRIEF DESCRIPTION OF THE DRAWINGS

The above features and other features and advantages of the invention will be more clearly apparent from the following description with reference to the appended drawings which illustrate a non-restrictive embodiment of the new protection system and in which.

DETAILED DESCRIPTION OF THE INVENTION

Figure 1:
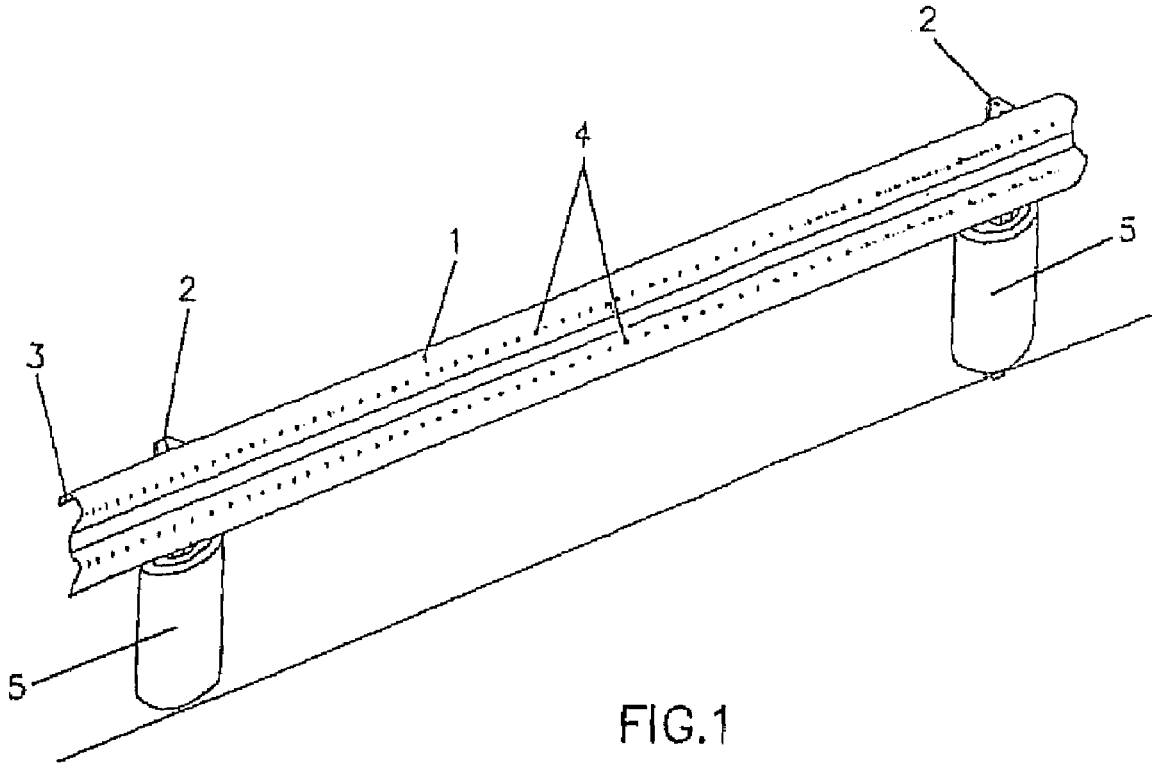
FIG. 1 is a perspective view of the system for the protection of road crash barriers according to the invention.
Figure 2:
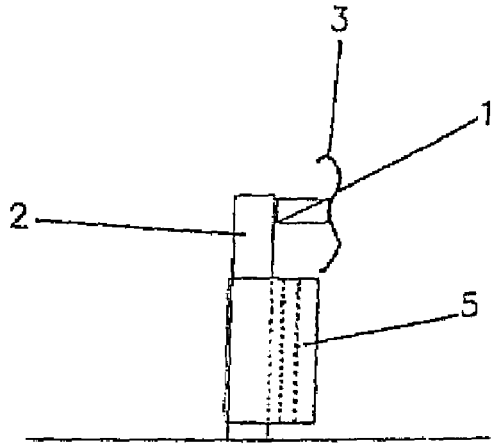
FIG. 2 is a view in elevation from one extremity showing the curved configuration of the top part of the barrier rail in the form of a corrugated crash barrier rail.

With reference to the drawings, it will be seen that the system protecting persons from impacts with road crash barriers according to the invention comprises barrier rails in the form of corrugated barrier rails 1 fixed to vertical supporting posts 2 anchored in the ground. Barrier rail 1 has a curved upper part 3 to prevent cuts in the event of anyone falling onto it and has a series of protuberances 4 in a longitudinal direction to absorb and decelerate the velocity of the vehicle or person striking it, and also to reduce the rebound effect.

Post 2 supporting barrier rail 1 is provided with a cladding 5 comprising various rings 6, 6', 6" of variable thickness which are open on one side and manufactured of material which deforms flexibly, but recovers immediately, and which incorporates a housing 7 designed to fit the post through pressure and a clamping effect, the inner surface 8 of the said housing having teeth or better attachment to the said post.

Although rings 6, 6', 6" may be of any number, it is preferred in the invention that there should be three.

Any material satisfying the flexibility, deformability or shape recovery requirements specified by the invention may be used as the deformable flexible material for rings 6, 6', 6". Nevertheless it is preferred that this material should be one selected from the group of plastics.

Even where the inherent elasticity of the cladding material 5 is sufficient to ensure satisfactory support of the latter on crash barrier post 2, for a more secure attachment housing opening 7 of the cladding may be secured with steel supporting clamps 9 engaging slots 10 provided for the purpose in said cladding 5.

As an alternative, appropriate adhesive bonding may be used instead of said supporting clamps 9 to improve the attachment of said cladding 5 to said post 2.

Figure 4:
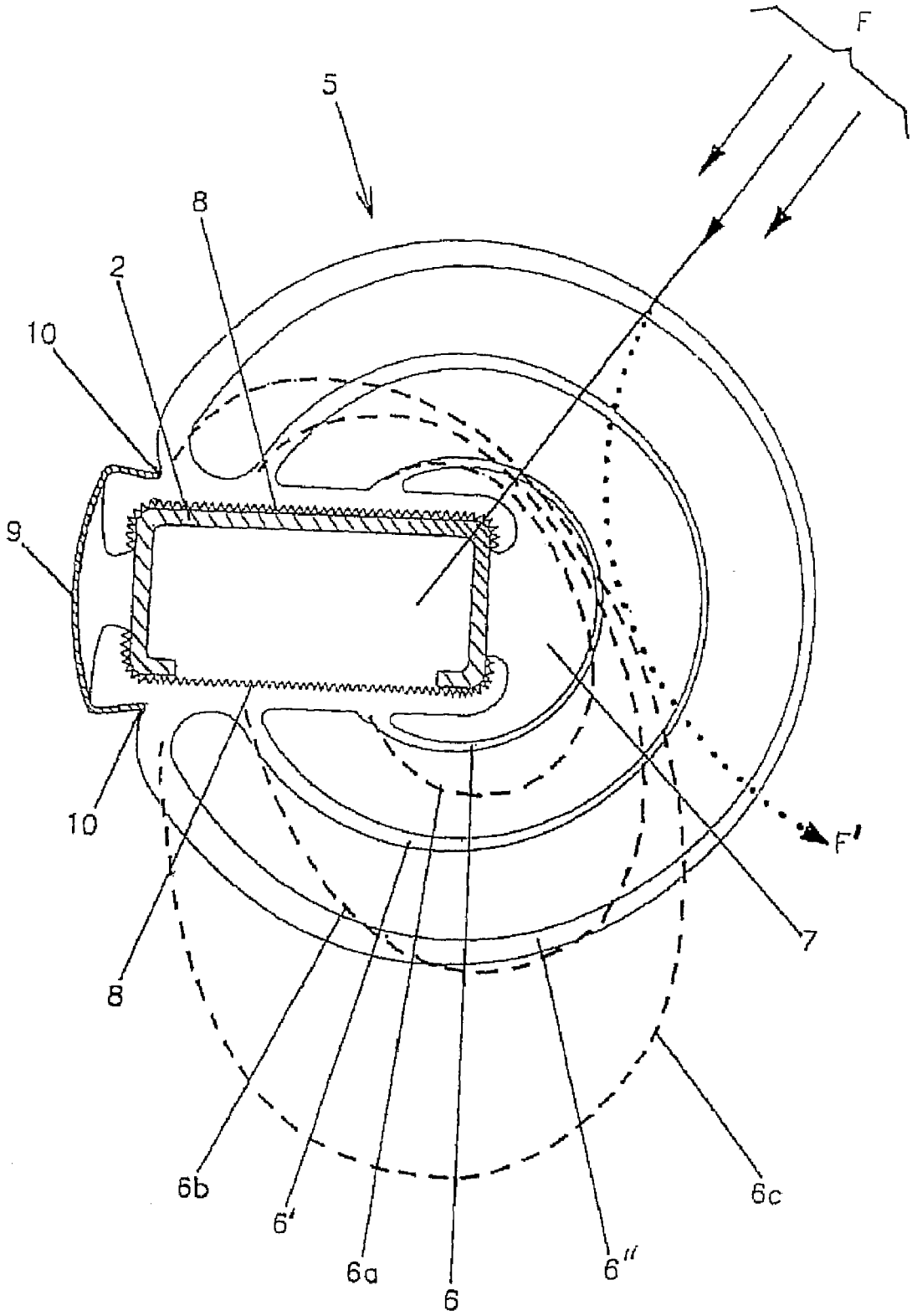
FIG. 4 is a view corresponding to FIG. 3 showing the manner in which the protection system according to the invention acts when suffering a lateral impact.

The method of operation of the protective system according to this invention will be seen from the illustration in FIG. 4, in which it will be seen that a body striking cladding 5 in the direction of arrows F is deviated in the direction of arrow F'. Likewise it will be seen in FIG. 4 that rings 6, 6', 6" deform along the corresponding thick lines 6*a*, 6*b*, 6*c*. This particular form of deformation of the said rings is due to their variable thickness design, which ensures more rigidity or more flexibility where these are required. This is a very useful feature of the system according to the invention, as it makes it possible to break down the impact into as many stages of different hardness/intensity as there are rings comprising cladding 5 (three rings 6, 6', 6" in the embodiment illustrated) as a result of these being constructed of different thickness and diameters.

By modifying anchorage housing 7, the system according to the invention can be adapted to the various types of posts 2 in existence, such as posts having a channel, H, X, O, etc., cross-section. It is possible to apply the system according to the invention to street lights, traffic lights, etc. In this way, in addition to allowing easy and economical fitting to existing infrastructure, high impact energy absorption and an "eccentric rotation" deviating an impact against post 2 is achieved.

The abovementioned "eccentric rotation" effect, which is a consequence of the variable thickness of rings 6, 6', 6", has the effect that the impact received by cladding 5 on post 2 is deviated, and thus the body impacting against that cladding suffers less. In addition to this, the presence of various rings 6, 6', 6" in the system according to the invention (a triple ring in the embodiment illustrated) makes it possible to break down the impact into various partial impacts of lesser severity, replacing one deceleration peak by a number of peaks of lesser intensity, with the consequent benefits which this provides for the accident victim.

Figure 5:
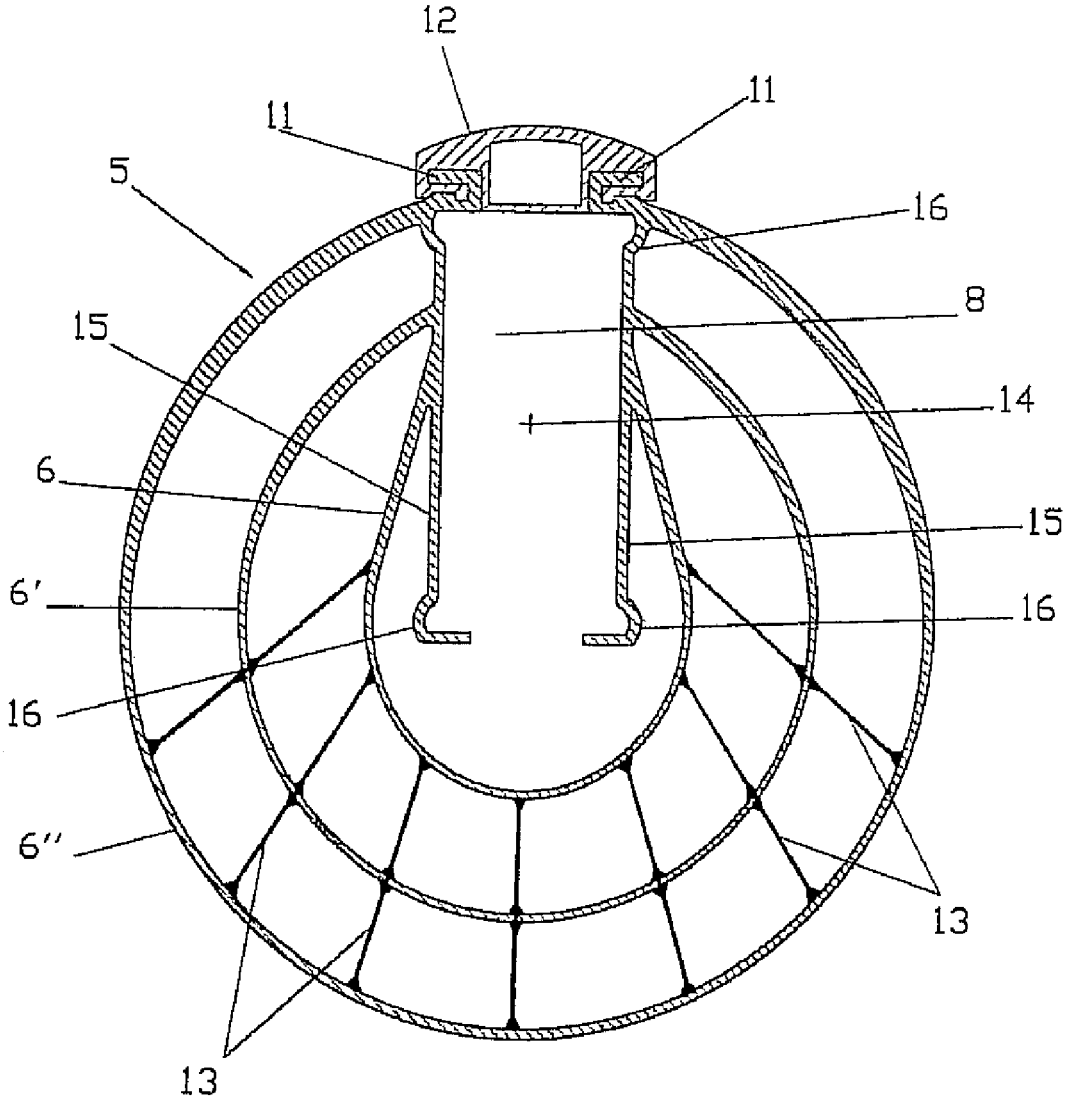
FIG. 5 corresponds to a second embodiment showing a plan view from above in partial cross-section.

As already indicated, FIG. 5 shows a second embodiment in which protective cladding 5 according to the invention is formed from a central core 8 which is open at its two extremities and is rounded off on its posterior external side by two flanges 11 opposite each other at right angles, designed to receive a short running attachment bar 12 to support the core on the post supporting the barrier rail (not illustrated). This core 8 has damping surfaces attached to it in the form of concentric rings 6, 6', 6" which extend from the posterior part thereof and have a slightly oval configuration and are attached to each other by means of a plurality of radial reinforcing walls 13, the imaginary extensions of which converge at the centre 14 of core 8, the outer ring 6" being thicker than the other inner rings 6, 6'.

Figure 3:
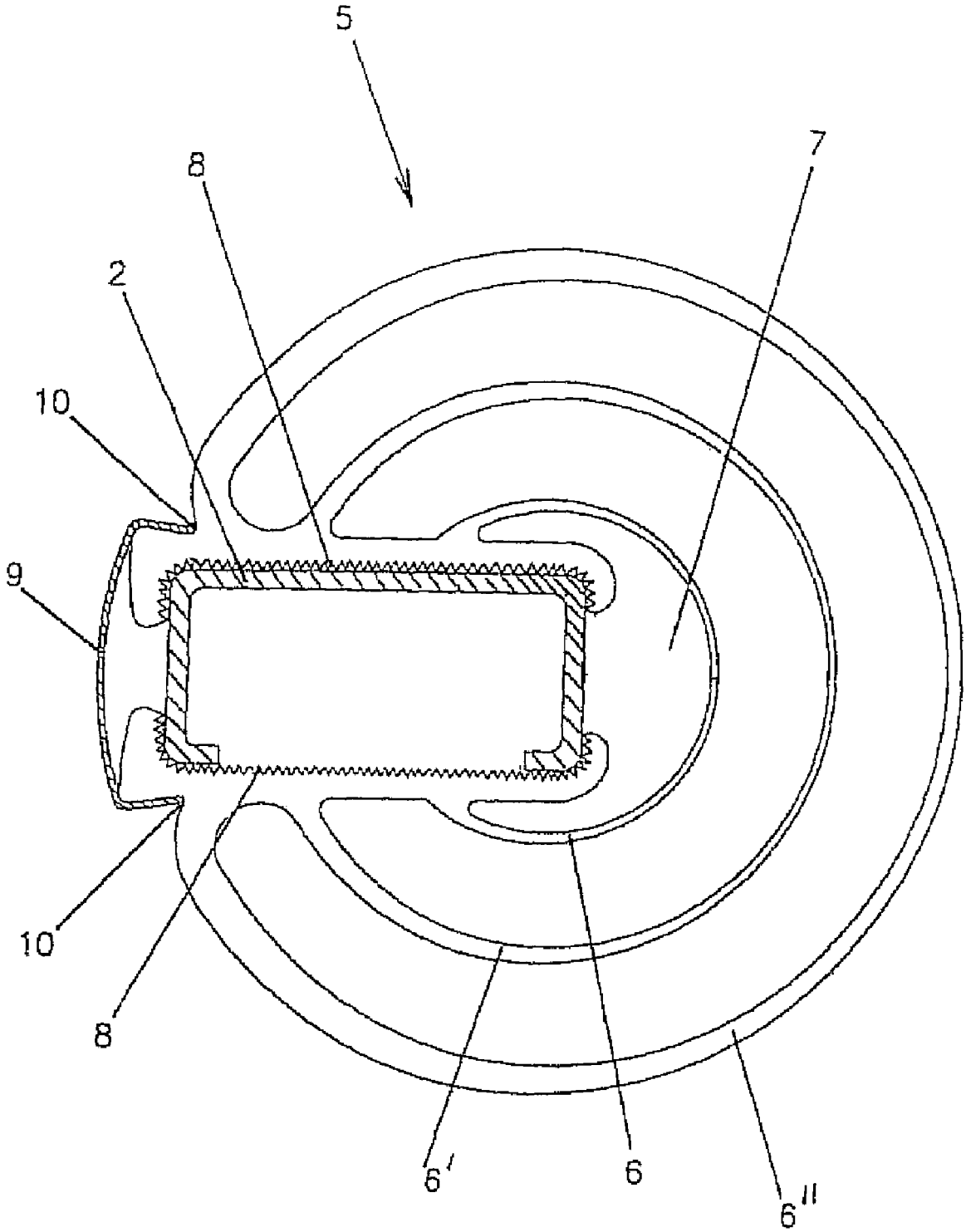
FIG. 3 is a plan view from above, in partial cross-section, showing the cladding applied to a post of the crash barrier.

As in the first embodiment in FIG. 3, the number of cylindrical rings 6, 6', 6" is preferably three, although a different number of rings may be chosen if this is considered necessary.

Core 8 of protective cladding 5 according to the invention has been designed with a transverse cross-section suitable for attachment to channel and I section posts or posts having any other configuration, provision being made in the event of the transverse cross-section of the post differing from the channel or I configuration or core 8 to be mounted therein by means of a coupling module fitting it (not shown in the drawing).

As will be seen in FIG. 5, side walls 15 of core 8 of protective cladding 5 according to the invention have outwardly flared extremities 16 to receive the flanges of posts having an I transverse cross-section.

Said FIG. 5 illustrates seven radial reinforcing walls 13 in protective cladding 5 according to the invention, although these walls may be in any other number recommended by the circumstances of practical use.

The system according to the invention can adapt to the various impacts which occur on highways or roads with traffic in two directions. It may also be designed for a single direction, by varying the thicknesses, angles of rotation, radii, slots, projections, number of rings, etc., according to the materials used.

A significant factor in the protective system according to the invention is its ability to absorb impacts originating through an arc of 270°, as a result of which it is effective against impacts which it might receive from one direction or the other of the highway or road in which it is installed. Specifically the system mentioned is designed to receive impacts over an arc of 270° (symmetrical system) on roads with traffic in two directions and is also especially designed to receive impacts originating from a single direction (asymmetrical system) in roads with one-way traffic.

The following must be mentioned as the most important advantages of the protective system according to the invention, as already mentioned in the prior description: a first advantage lies in the fact that the body impacting against cladding 5 on post 2 is deviated away from it, thus reducing the effects of the impact received by the accident victims. Another advantage lies in the fact that the part of cladding 5 which absorbs most impact, as a result of its eccentric shape, lies in the trajectory of the impacts and breaks down the impact into a number of stages of different intensity (three stages in the case of the three rings 6, 6', 6" illustrated), decreasing the one maximum deceleration peak into as many lesser peaks. A third advantage lies in the fact that the system according to the invention prevents direct impact with post 2 because of its "eccentric rotation" or tilting effect. To sum up, what is achieved through the protective system according to the invention is that the direct impact of an accident victim against post 2 is deviated into another less harmful direction.

Although cladding 5 has been illustrated in the drawings as having a generally cylindrical ring shape for a better understanding of the protective system according to the invention, it will be understood that the principle of impact displacement, absorption and diversion can also be applied to claddings having a square, triangular, diamond, etc., transverse cross-section.

The essential features of the subject matter of this invention have been pointed out above. Nevertheless, it will be understood that the embodiment described in this description and illustrated in the drawings will permit a number of changes in detail without going beyond the scope of the invention. The scope of the invention is therefore defined solely and exclusively by the content of the appended claims.

The invention claimed is:

1. In a system for providing protection during impact against highway crash barriers of the type comprising horizontally extending rails adapted to be supported along a roadway by attachment to vertical supporting posts anchored in the ground, the improvement comprising: a cladding complex comprising a plurality of planar surfaces arranged in the form of concentric rings adapted to extend along the height of said supporting posts and having their opposed ends terminating in a housing structure which engages opposed sides of each post, the housing structure having an open end to allow it to be attached to said posts, the concentric rings extending outwardly from the post in the direction of the roadway beyond the roadway facing side of the post, the concentric rings each having a thickness that decreases progressively from their ends which attach to the housing to reach a minimum thickness at their central portions which extend from the post in the direction of the roadway.

2. The system of claim 1 further comprising a series of longitudinally spaced protuberances formed along the side of the rails which face the roadway to absorb energy of a vehicle impacting the rail.

3. The system of claim 1 in which the sections of the housing which engage the posts are formed with teeth to achieve better attachment to the posts.

4. The system of claim 1 in which the housing is open at its extremity away from the roadway and is terminated at its outer side by two clamp sections disposed opposite to each other designed to receive an attachment bar joined at its ends to the two clamp sections to support the core on the post supporting the barrier rail.

5. The system of claim 1 in which the concentric rings are formed of a deformable flexible plastic with the ability to reassume their concentric relationship when an impacting force is removed.

6. The system of claim 1 wherein the complex comprises three planar surfaces arranged in the form of concentric rings.

7. The system of claim 1 in which the housing is attached to its supporting post by an adhesive.

* * * * *